US006843686B2

(12) United States Patent
Ohnishi et al.

(10) Patent No.: US 6,843,686 B2
(45) Date of Patent: Jan. 18, 2005

(54) HIGH-FREQUENCY ELECTRIC CONNECTOR HAVING NO GROUND TERMINALS

(75) Inventors: Koji Ohnishi, Tokyo (JP); Masahiko Matsue, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/421,735

(22) Filed: Apr. 24, 2003

(65) Prior Publication Data

US 2003/0203665 A1 Oct. 30, 2003

(30) Foreign Application Priority Data

Apr. 26, 2002 (JP) ..... 2002-126010

(51) Int. Cl.[7] ..... H01R 13/648
(52) U.S. Cl. ..... 439/608; 439/941
(58) Field of Search ..... 439/608, 101, 439/108, 941

(56) References Cited

U.S. PATENT DOCUMENTS 4,571,014 A * 2/1986 Robin et al. ..... 439/108
4,975,084 A * 12/1990 Fedder et al. ..... 439/608
5,037,332 A * 8/1991 Wilson ..... 439/608
5,044,992 A * 9/1991 Dzwonczyk et al. ..... 439/608
5,297,970 A * 3/1994 Carney ..... 439/108
5,342,211 A * 8/1994 Broeksteeg ..... 439/108
5,354,219 A * 10/1994 Wanjura ..... 439/608
5,507,655 A * 4/1996 Goerlich ..... 439/108
6,116,926 A * 9/2000 Ortega et al. ..... 439/108
6,347,962 B1 * 2/2002 Kline ..... 439/608
6,443,740 B1 * 9/2002 Evans ..... 439/63
6,478,624 B2 * 11/2002 Ramey et al. ..... 439/608
6,503,103 B1 * 1/2003 Cohen et al. ..... 439/608
6,540,558 B1 * 4/2003 Paagman ..... 439/608
6,551,140 B2 * 4/2003 Billman et al. ..... 439/608
2002/0111068 A1 * 8/2002 Cohen et al. ..... 439/608
2003/0143894 A1 * 7/2003 Kline et al. ..... 439/608

* cited by examiner

*Primary Examiner*—Javaid H. Nasri
(74) *Attorney, Agent, or Firm*—Wenderoth, Lind & Ponack, L.L.P.

(57) ABSTRACT

An electric connector includes an insulating housing having slots arranged crosswise in vertical columns and horizontal lines, and signal terminals received in the slots. The signal terminals are paired to be received in each and every slot. The slots are staggered in vertical columns. The slots are so arranged that the ratio of "a"/"b" may be equal to or smaller than ⅓, where "a" stands for the distance between two signal terminals in each pair, and "b" stands for the distance between adjacent pair sets of signal terminals.

24 Claims, 12 Drawing Sheets

HIGH-FREQUENCY ELECTRIC CONNECTOR HAVING NO GROUND TERMINALS

BACKGROUND OF THE INVENTION

1. Field of the Invention

The present invention relates to an electric connector for use in making a required electric connection between printed circuit boards, between a printed circuit board and a selected device in a computer, or between a printed circuit board and a server or backboard package, and more particularly to an electric connector for use in transmitting high-frequency signals.

2. Related Art

Referring to FIG. 10, a conventional electric connector 11 has a plurality of pair sets of 12 signal terminals 12*a* and 12*b* for transmitting high-speed signals in differential transmission ways, thereby significantly reducing noise signals. More specifically, if cross talk appears between the pair of signal terminals 12*a* and 12*b*, unwanted signals of the same phase can be cancelled. Also, a ground terminal 13 is arranged between adjacent pair sets 12 of the signal terminals, thereby preventing cross talk from appearing in adjacent pair sets of signal terminals.

Such a conventional electric connector uses extra ground terminals, and accordingly the number of parts to be assembled, and hence, the manufacturing cost will increase. The more the terminal-loading density increases, the narrower the distance between the ground terminal 13 and the signal terminal 12*a* or 12*b* of either adjacent pair set decreases, and the larger the signal energy will be lost by the nearby ground terminal 13. Thus, the insertion loss which is caused by inserting the electric connector in the signal-transmitting circuit increases.

The inter-distance "b" between adjacent signal terminals in each pair set decreases, and accordingly the thickness of the signal terminal is reduced. Disadvantageously such thin signal terminals are apt to be deformed or bent in press fitting in selected terminal slots in the connector body.

The signal terminals 12*a* and 12*b* of each set are arranged vertically at different levels. Therefore, the upper conductor 12*a* extending from the upper level to an associated printed circuit board at the lowest level is longer than the lower conductor 12*b* extending from the lower level to the printed circuit board. As a result the electric signals traveling such different lengths of conductors 12*a* and 12*b* reach the printed circuit board at different times, thus causing noises from the electric signals which appear in the pair set of signal terminals 12*a* and 12*b*.

One object of the present invention is to provide a high-frequency electric connector which is free of such defects as described above.

SUMMARY OF THE INVENTION

To attain this object an electric connector comprising an insulating housing having a plurality of slots arranged crosswise in vertical columns and horizontal lines, and a corresponding plurality of signal terminals received in the slots, is improved according to the present invention in that the signal terminals are paired to be received in each and every slot.

With this arrangement a pair of conductors conveying one and the same signal are equal in length so that each signal may travel the same distance to reach the same place at the same time. Thus, the signals traveling the pair set of conductors cause no interference with each other, and no cross talk can be caused. The slots may be staggered in their vertical arrangements. The staggered arrangement of pair sets of conductors has the effect of preventing the cross talk from appearing between adjacent pair sets of conductors.

The pair sets of signal terminals have no grounding conductor therebetween, and therefore, the energy of the signal cannot be lost while passing through the connector. Accordingly the high-speed signal transmission characteristics can be improved.

The slots may be so arranged that a/b may be equal to or smaller than ⅓, where "a" stands for the distance between two signal terminals of each pair set, and "b" stands for the distance between adjacent pair sets. This arrangement has the effect of significantly improving the high-speed signal transmission characteristics while minimizing the size of the electric connector with the density of signal terminals per unit area remaining high.

Each pair of signal terminals has their conductors extending parallel to each other, and their parallelism continues to the farthest possible extremities, that is, to the points at which the signal terminals are connected to selected conductors in an associated printed circuit board.

Counter terminals to be mated with each pair of signal terminals are paired, also. Each pair set of counter terminals is arranged in parallel at the minimum possible interval, and is combined by an intervening insulating member as a whole. The integral joint of two conductors makes them resistant to the applied force occurring during press fitting in the slots of the electric connector, preventing them from being bent or deformed which might cause a short-circuit thereacross.

The parallel, close arrangement of conductors in the electric connector has the effect of increasing the electromagnetic coupling between paired conductors, reducing the loss of signal energy, and improving the high-speed signal transmission characteristics.

Other objects and advantages of the present invention will be understood from the following description of an electric connector according to one preferred embodiment of the present invention, which is shown in the accompanying drawings.

BRIEF DESCRIPTION OF THE DRAWINGS

FIG. 5 illustrates how bifurcate ends of the female contact pieces of each pair are inserted in a selected slot.

FIG. 6 illustrates a female package part of a electric connector.

FIG. 8 illustrates a male package part of the electric connector.

FIG. 9(A) is a plan view of a male contact piece, whereas

FIG. 13(A) shows a printed circuit board in respect of through-holes, whereas

DETAILED DESCRIPTION OF THE PREFERRED EMBODIMENT

Figure 1:
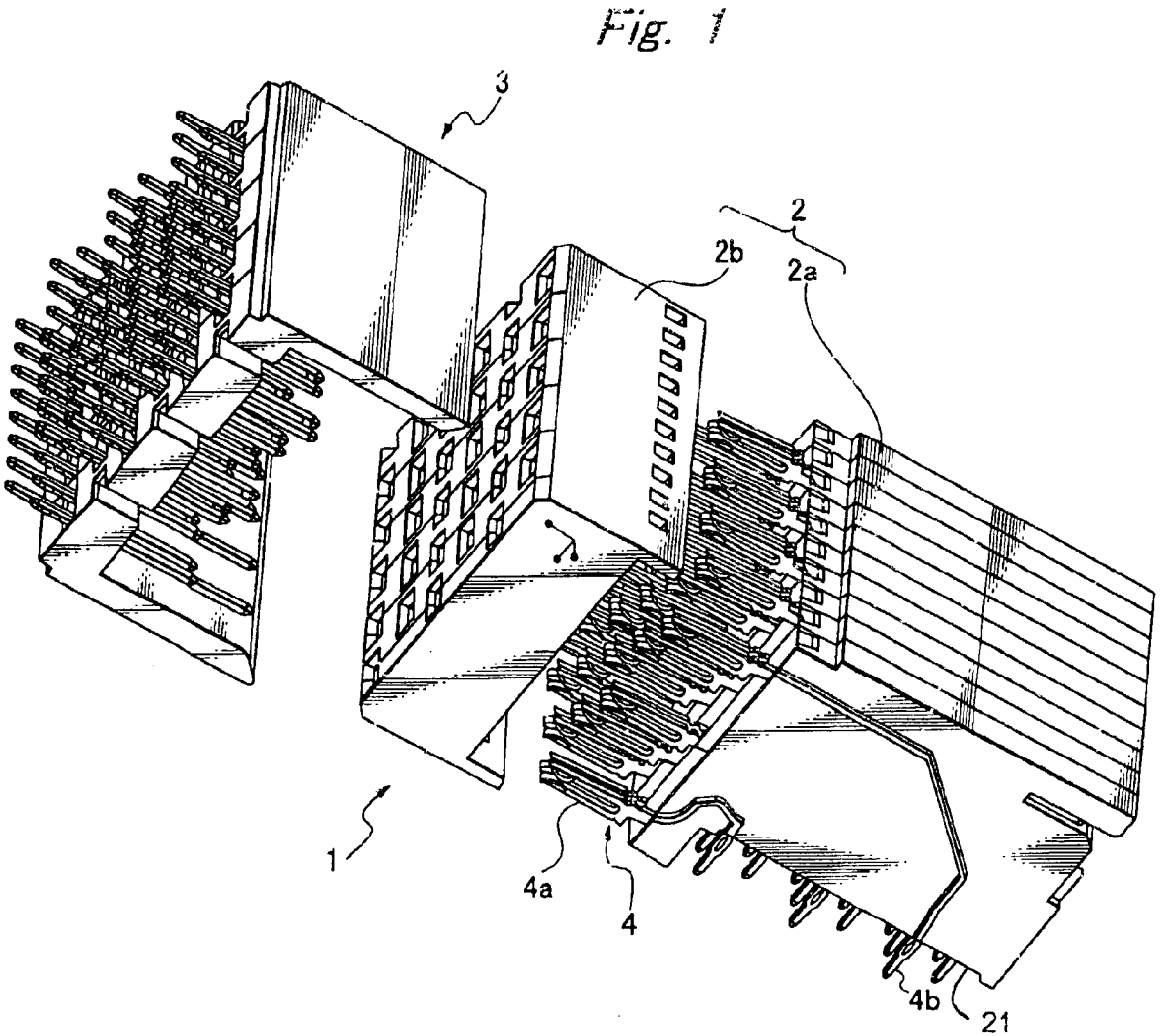
FIG. 1 is an exploded perspective view of a multi-column electric connector according to the present invention.
Figure 2:
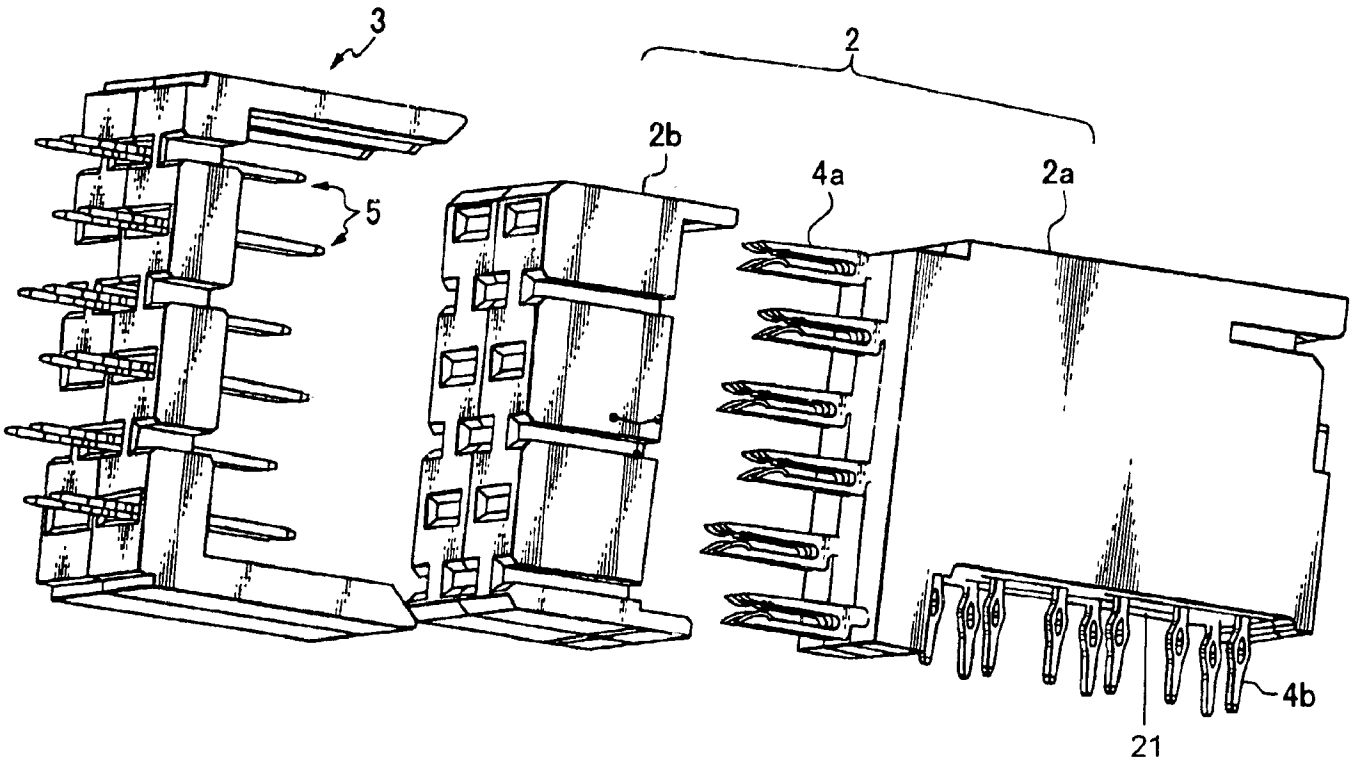
FIG. 2 is a similar view, illustrating a two-column electric connector.
Figure 3:
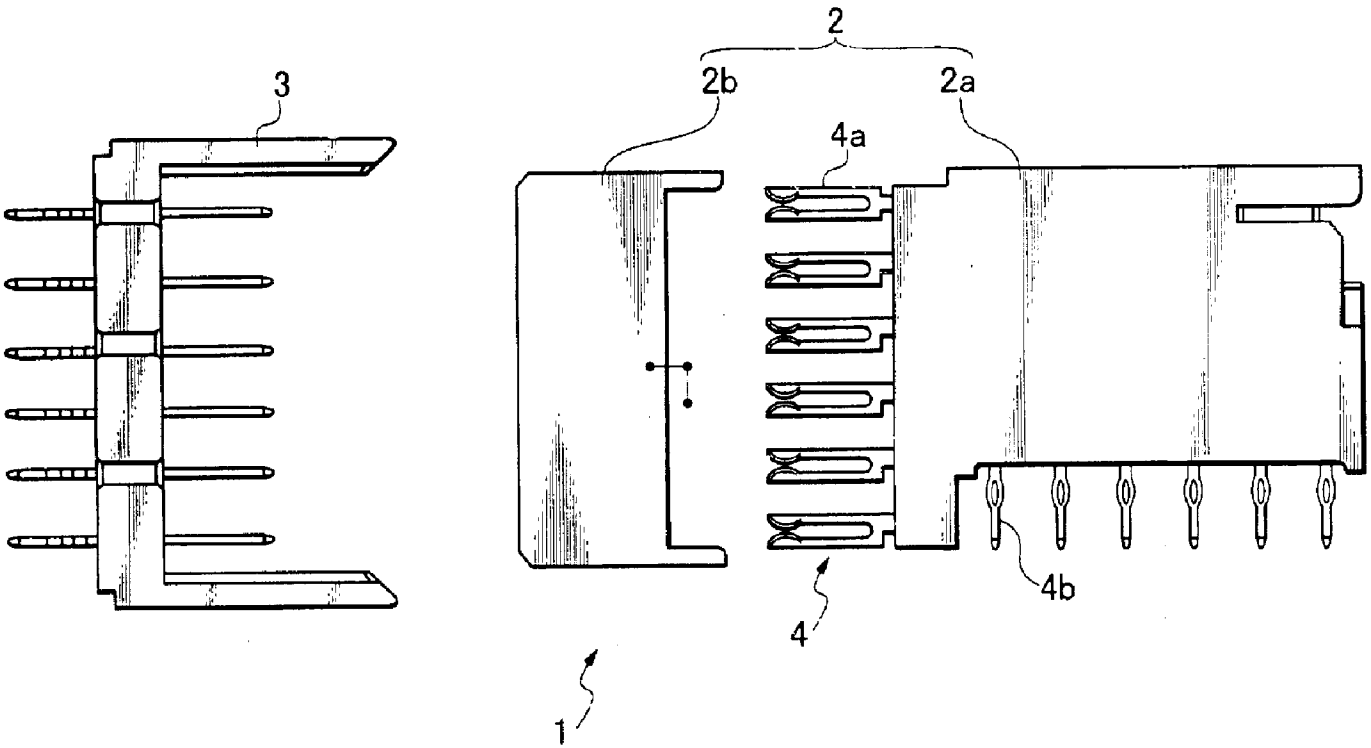
FIG. 3 is a side view of the connector.

Referring to FIG. 1, an electric connector 1 comprises a female package part 2 and a male package part 3. The female package part 2 comprises a rectangular block 2*a* and a detachable rectangular insulating housing 2*b* to be fitted on the front side of the rectangular block 2*a*. The male package part 3 is a "U"-shaped cover to be applied to the rectangular insulating housing 2*b*.

The rectangular block (terminal mounting blocks) 2*a* has a raised bottom surface 21 to be laid on an associated printed circuit board. The rectangular insulating housing 2*b* has female slots arranged in a lattice form. Likewise, the "U"-shaped cover 3 has slots arranged in the same lattice pattern as the rectangular insulating housing 2*b*.

Figure 4B:
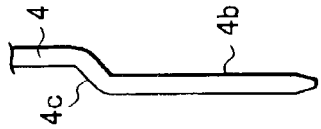
FIG. 4(B) shows the non-bifurcate end of a female contact piece.
Figure 4A:
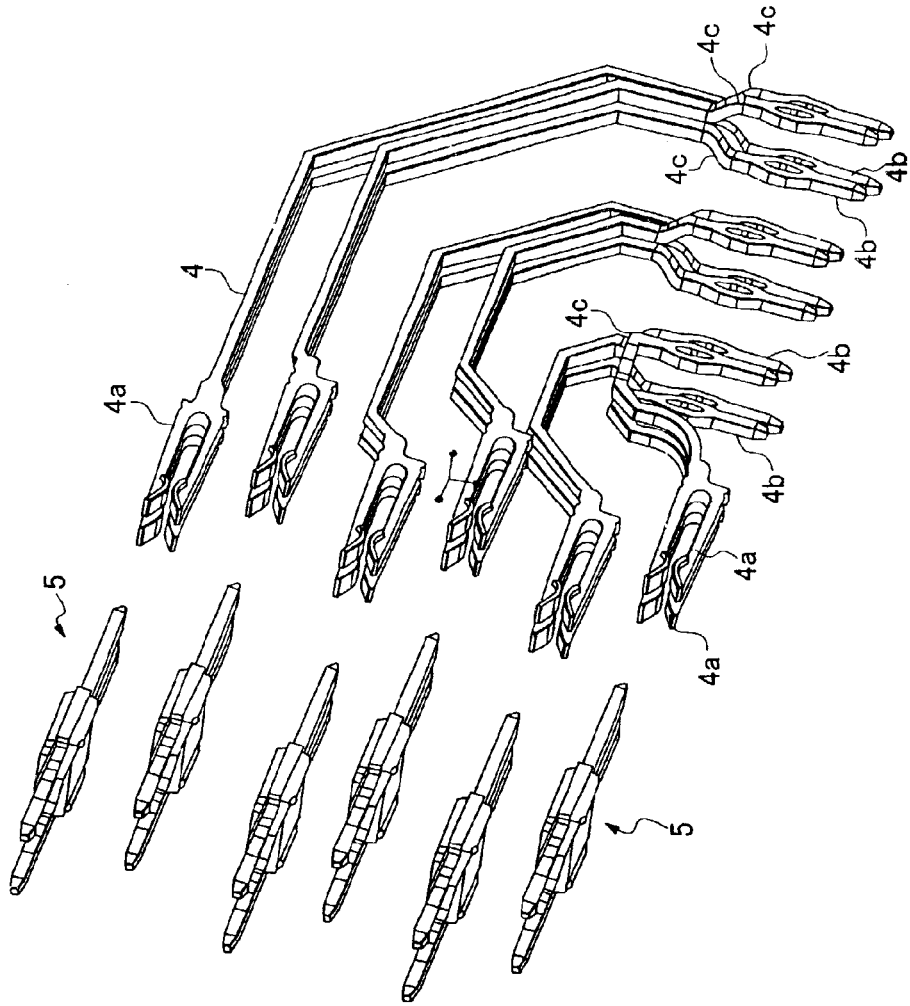
FIG. 4(A) illustrates how male contact pieces and female contact pieces can be mated.

Referring to FIG. 4(A), each female contact piece (signal terminal) 4 is composed of a bifurcate contact end 4*a*, a non-bifurcate contact end 4*b* directed perpendicular to the bifurcate contact end 4*a*, and a curved or bent stem integrally connected at its opposite ends both to the bifurcate contact end 4*a* and non-bifurcate contact end 4*b*. The stem-to-non-bifurcate-contact-end transition section 4*c* is bent outward as seen from FIG. 4(B). Thus, a pair of female contact pieces 4 are arranged in parallel and spaced apart from each other over their non-bifurcate contact ends. A plurality of pair sets of female contact pieces 4 are embedded (or insert-molded) in the rectangular block 2*a* of the female package part 2 with their bifurcate contact ends 4*a* appearing on its front side, and with their non-bifurcate contact ends 4*b* appearing on its raised bottom surface. In this particular example each female contact piece is about 0.4 mm thick, and two female contact pieces 4 are arranged in parallel about 0.4 to 0.5 mm apart from each other. The pair sets of female contact pieces are crosswise arranged in 6 horizontal lines and 6 vertical columns.

The rectangular insulating housing 2*b* can be applied to the front side of the rectangular block 2*a* with the bifurcate contact ends 4*a* inserted in the slots of the rectangular insulating housing 2*b*.

Referring to FIG. 4(A), two male contact pieces 5 are combined by an intervening joint to provide a pair set of male contacts as a whole. The male package part 3 has pair sets of male contacts 5 inserted in its slots with their opposite contact extensions appearing on the front and rear sides of the major slotted-plate of the "U"-shaped body 3. When the male package part 3 is applied to the rectangular insulating housing 2*b* of the female package part 2, the rear contact extensions of the paired male contact pieces 5 are received in the slots of the rectangular insulating housing 2*b* to mate with the bifurcate contact ends 4*a* of the female contact pieces 4.

Figure 13A:
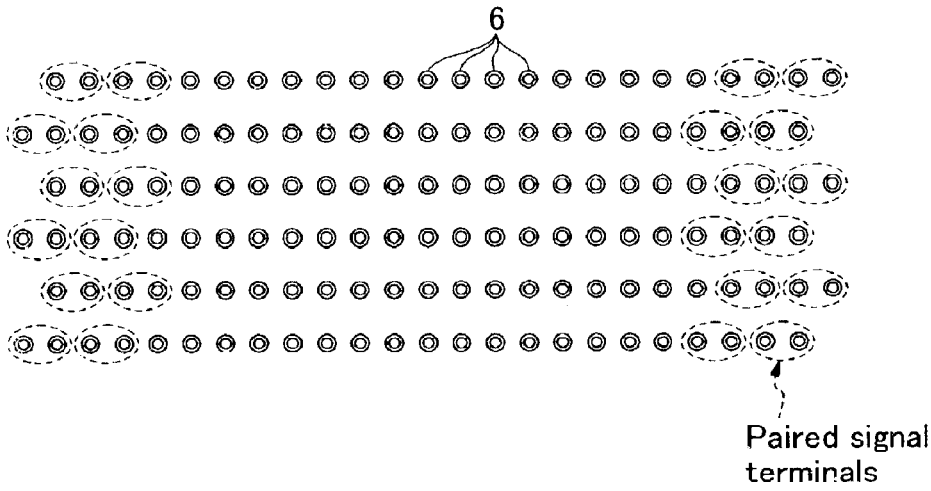
Figure 13B:
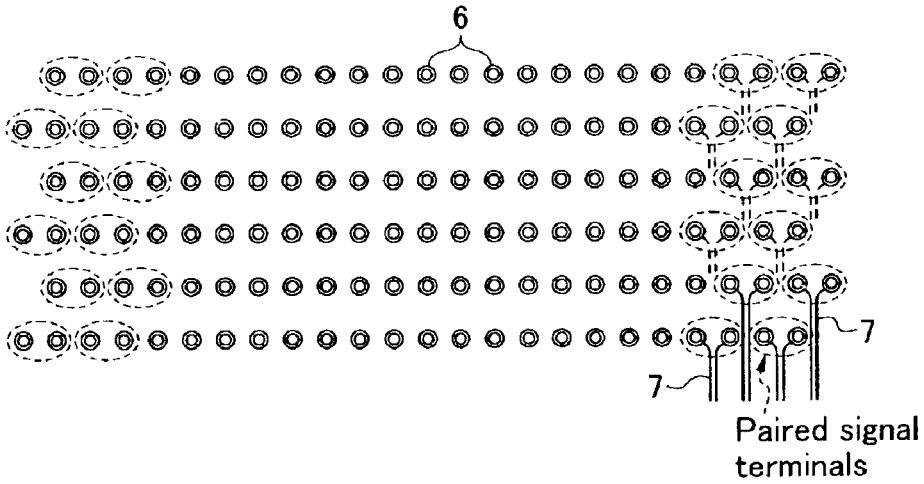
FIG. 13(B) shows the printed circuit board in respect of how lead wires are connected to through-holes.

Referring to FIGS. 13(A) and 13(B), the printed circuit board has terminal through-holes 6 arranged in a lattice pattern. These terminal through-holes 6 are 2 mm apart from each other, and two lead wires 7 are soldered to adjacent through-holes 6 to extend between adjacent through-holes 6, as shown in FIG. 4(B). As described earlier, the bifurcate contact end-plus-stem lengths of each pair of female contact pieces 4 are arranged in parallel to be 0.4 to 0.5 mm apart from each other, and their non-bifurcate contact ends 4*b* are arranged in parallel to be 2 mm apart from each other, thereby permitting the non-bifurcate contact ends 4*b* to be inserted into selected adjacent through-holes 6 in the printed circuit board. Thus, the paired female contact pieces 4 can be kept close, and parallel to each other as far as possible, thus minimizing the insertion loss in the electric connector.

Figure 5A:
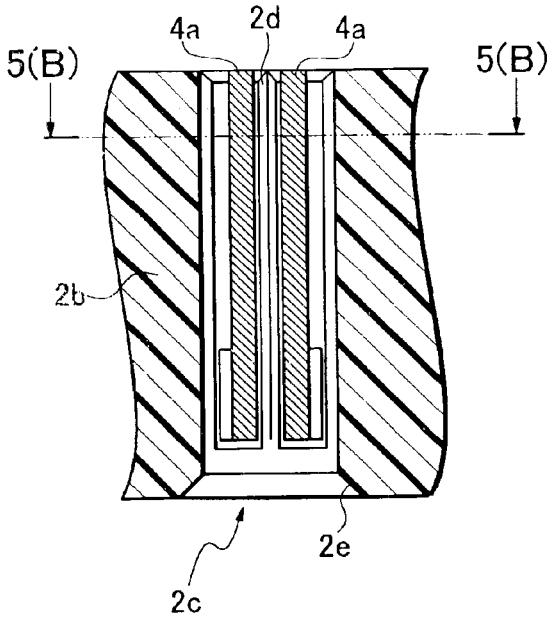
FIG. 5(A) is a sectional view of a fragment of a rectangular insulating housing.
Figure 5B:
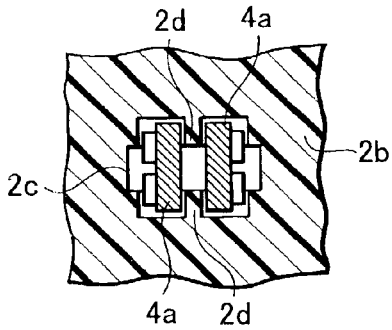
FIG. 5(B) is a sectional view of the fragment taken along the line 5(B)—5(B) in FIG. 5(A)
Figure 5C:
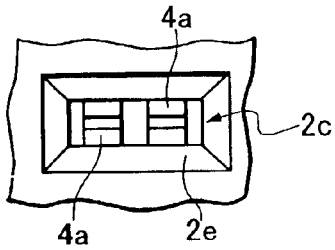
FIG. 5(C) is a front view of a terminal slot.

Referring to FIGS. 5(A)–5(C), each slot 2*c* of the rectangular insulating housing 2*b* has a vertical partition 2*d* formed therein, thereby assuring that the opposite bifurcate contact ends 4*a* of the paired female contact pieces 4 will be electrically isolated from each other. The slot 2*c* has its four sides 2*e* chamfered, and its center vertical partition is tapered. Thus, insertion of the paired male contact pieces 5 is facilitated.

Figures 6A, 6B, 6C:
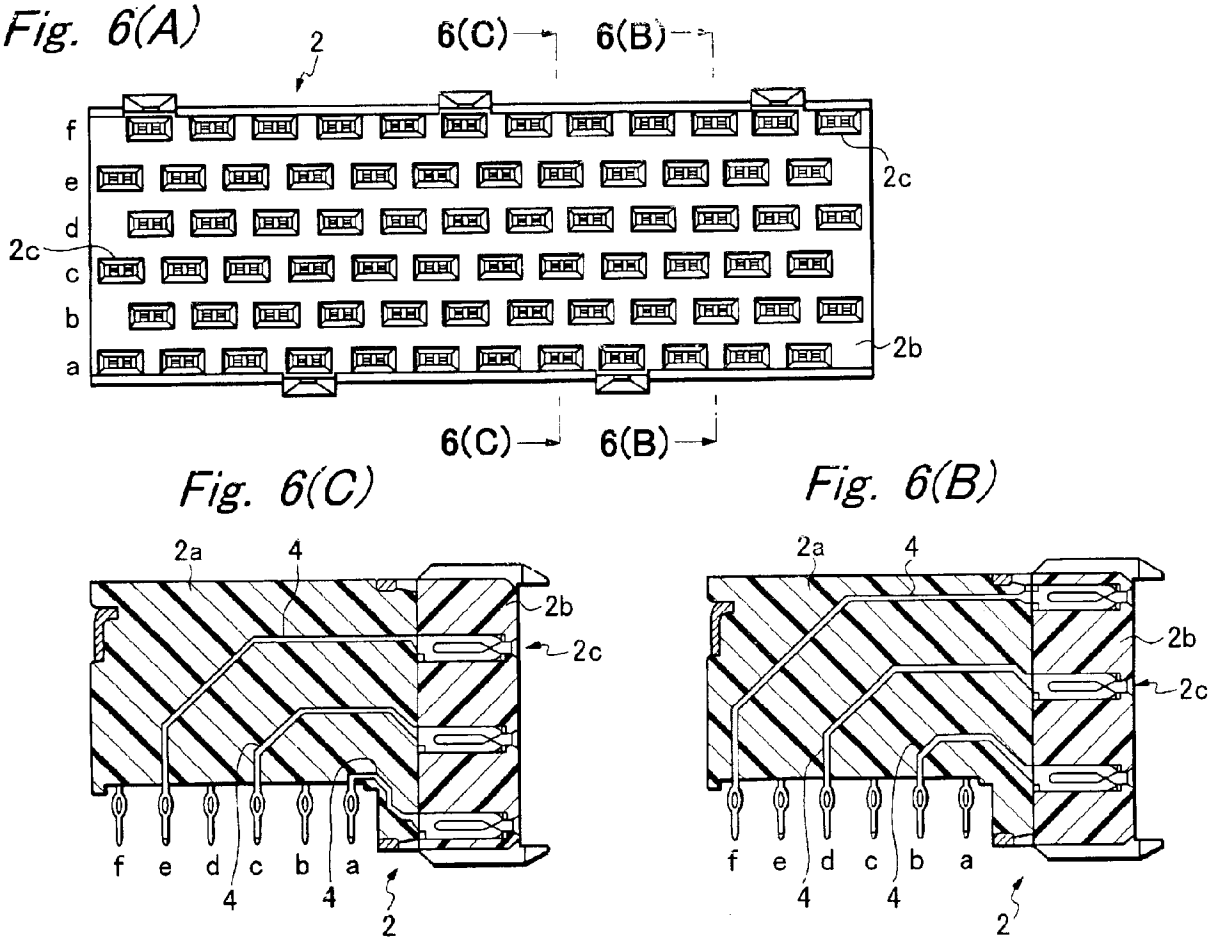
FIG. 6(A) is a front view of the female package.
FIG. 6(B) is a sectional view taken along the line 6(B)—6(B) in FIG. 6(A)
FIG. 6(C) is a sectional view taken along the line 6(C)—6(C) in FIG. 6(A)
Figure 7:
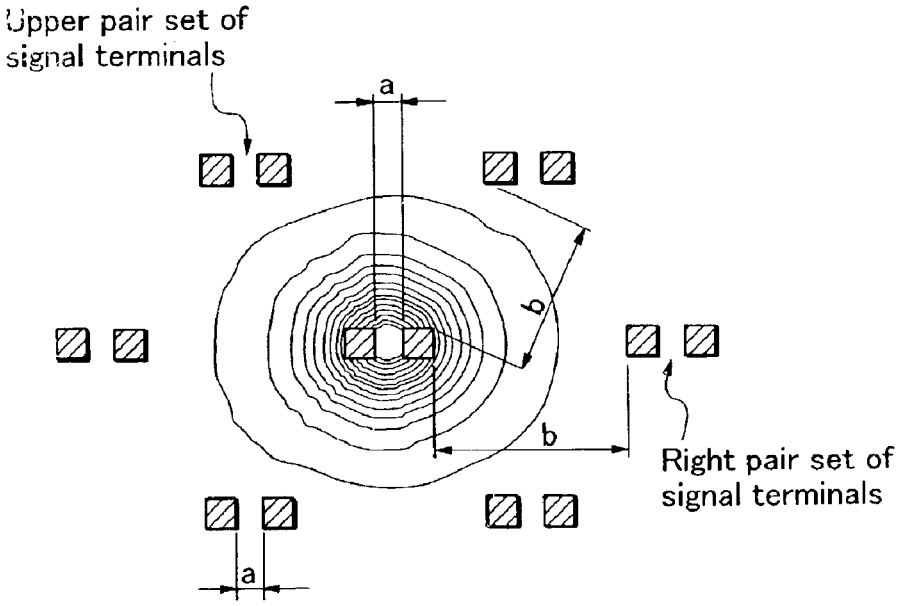
FIG. 7 illustrates how pair sets of female contact pieces are arranged, and how the lines of electric force are distributed.
Figure 8A:
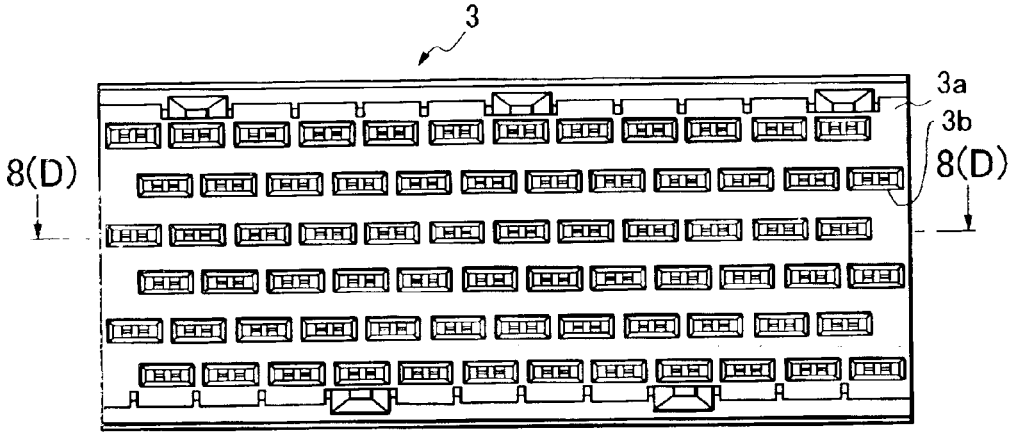
FIG. 8(A) is a front view of the male package.
Figure 8C:
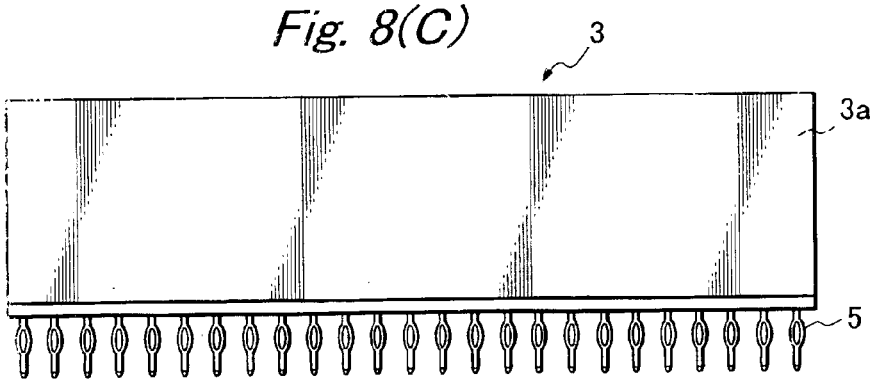
FIG. 8(C) is a bottom view of the male package.
Figure 8B:
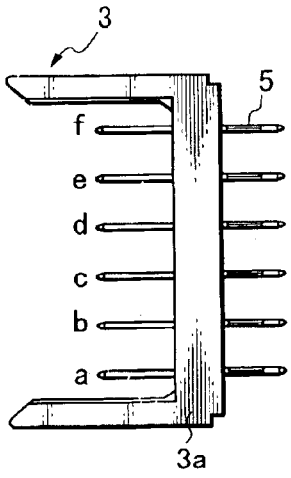
FIG. 8(B) is a side view of the male package.
Figure 8D:
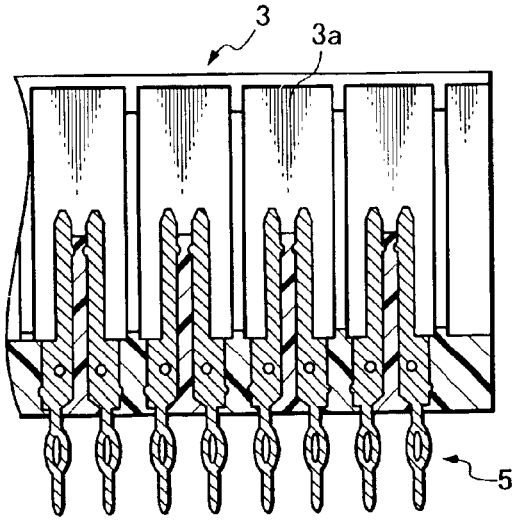
FIG. 8(D) is a sectional view of the male package taken along the line 8(D)—8(D) in FIG. 8(A)

Referring to FIG. 6(A), the female slots 2*c* are vertically staggered with an offset of half of the slot-to-slot distance. Referring to FIG. 7, the female slots 2*c* are so arranged that the ratio of "a"/"b" may be equal to or smaller than ⅓, where "a" stands for the distance between two female contact pieces 4 in each pair (0.4 to 0.5 mm), and "b" stands for the distance between horizontally- or obliquely-adjacent paired female contact pieces 4. For example, the contact-to-contact distance "a" in the pair is equal to about 0.5 mm, and then, the horizontal distance "b" between horizontally adjacent contact pairs is equal to 1.5 mm. The oblique distance "b" between vertically adjacent contact pairs is equal to 1.6 mm. The longer the distance "b" is, the better the noise-reduction effect is. To meet the desire for increasing the density of contact pieces per unit area of the front of the rectangular insulating housing 2*b* determination of the ratio of "a"/"b" as being equal to or smaller than ⅓ is a compromise between the significant noise reduction effect and the permissible contact density.

Referring to FIGS. 8(A)–8(D), the male package part 3 is an insulating housing 3*a* having male contact pieces (counter terminals) 5 press-fitted in its slots 3*b*.

Figure 9A:
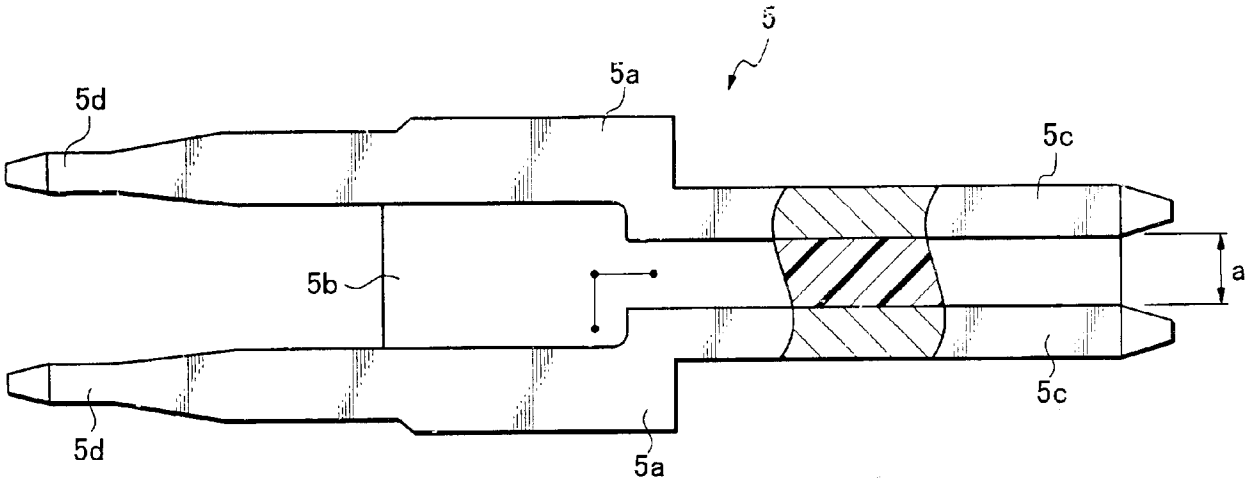
Figure 9B:
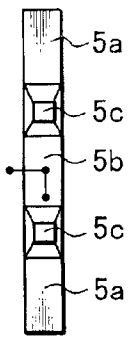
FIG. 9(B) is a front view of the male contact piece.
Figure 10:
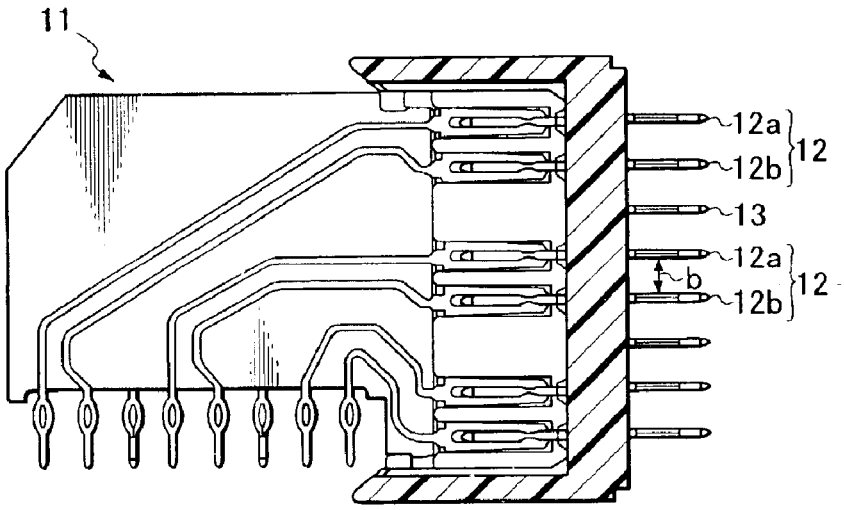
Fig. 10 PRIOR ART
FIG. 10 is a sectional side view of a conventional electric connector.

The male contact slots 3*b* are arranged in the same pattern as the female contact slots 2*c* in the female package part 2. Referring to FIGS. 9(A) and 9(B), pairs of male contact pieces 5*a* are arranged in parallel and integrally connected by filling an insulating resin material 5*b* therebetween. This assures that the parallel contact pieces 5*a* are arranged at a minimum possible interval, while still being kept stable in position. The slots 3*b* of the male package part 3 are filled with paired sets 5 of male contact pieces 5*a*.

The rear extensions 5*c* of the paired male set are spaced apart from each other by a distance substantially equal to the contact-to-contact distance "a" in the paired set on the female side. The front extensions 5*d* of the paired male set are spaced apart from each other by a distance equal to the through-hole-to-through-hole distance in another printed circuit board, and the front extensions 5*d* of the paired set are arranged in the same lattice pattern as the through-holes in the printed circuit board.

The electric connector 1 according to the present invention provides advantages of significantly reducing the cross talk and the insertion loss as shown in the following Table.

TABLE

Figure 11:
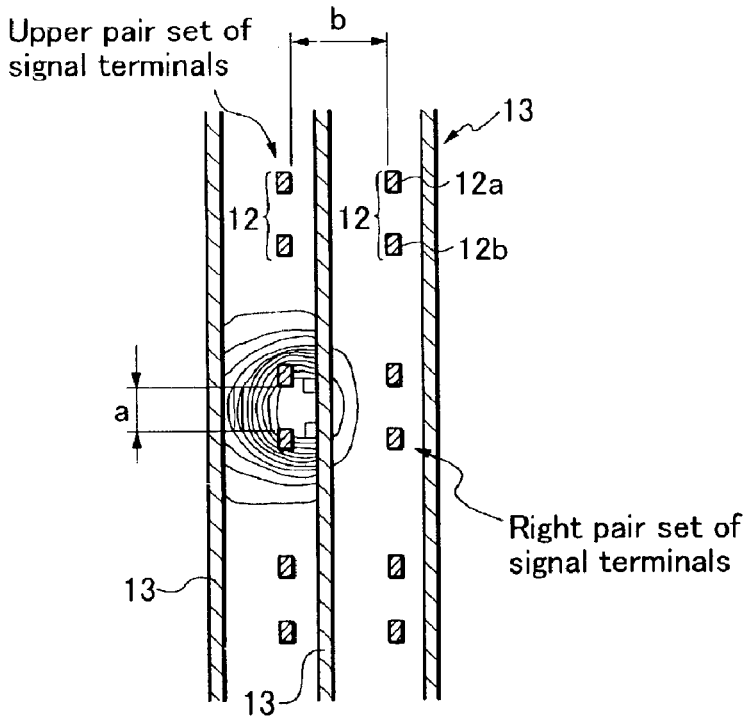
Fig. 11 PRIOR ART
FIG. 11 illustrates how pair sets of terminals are arranged in the conventional electric connector, and how the lines of electric force are distributed.
Figure 12:
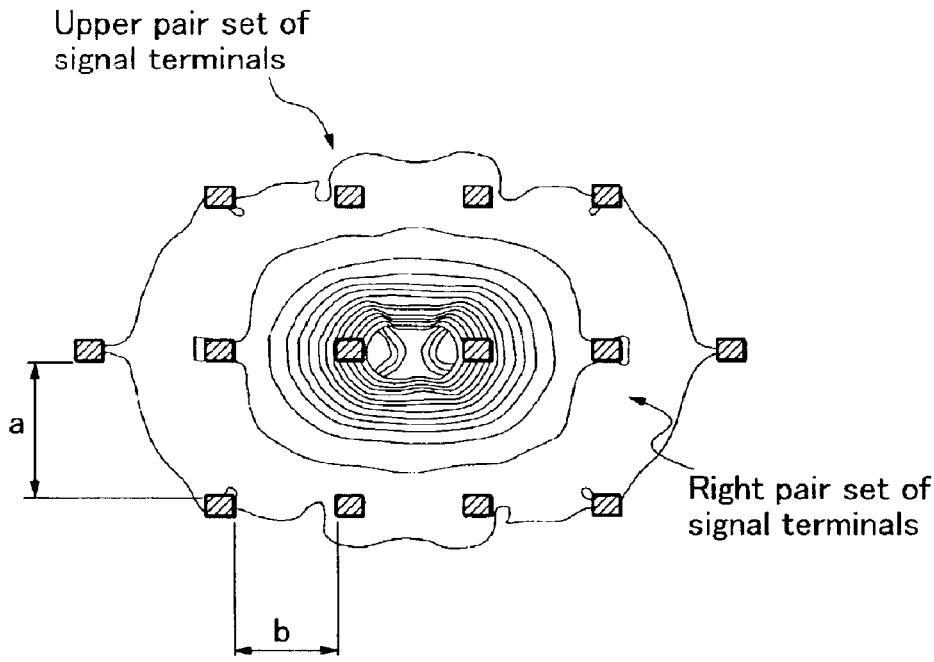
Fig. 12 PRIOR ART
FIG. 12 illustrates how contact pieces are arranged in the conventional electric connector, and how the lines of electric force are distributed.

| | ratio of "a"/"b" | insertion loss (db) | cross talk % |
|---|---|---|---|
| Connector 1 | 1/3 | 0.027 (5 GHZ) | 0.2 (up side) |
| | | 0.286 (20 GHZ) | 0.6 (right side) |
| Conventional Connector: FIG. 11 (high-speed type) | 1/2.8 | 0.052 (5 GHZ) | 0.4 (upper side) |
| | | 0.360 (20 GHz) | 0.1 (right side) |
| Conventional Connector: FIG. 12 (low-, medium-speed type) | 1/1 | 0.135 (5 GHZ) | 1.7 (upper side) |
| | | 3.813 (20 GHz) | 3.2 (right side) |

In FIGS. 11 and 12 concentric circles indicate lines of electric forces. The reduction of insertion loss is attributable to use of no grounding terminals or shields. The close parallelism is maintained as far as the non-bifurcate end, at which the paired female contact pieces are connected to the printed circuit board. Thus, the signals travel the same length for each of the paired conductors to arrive at the printed circuit board simultaneously, and therefore, the cross talk is minimized even though no grounding terminals are used.

The staggered arrangement of pair sets of contact pieces permits significant increase of the distance "b" between adjacent pair sets, thus permitting the female contact piece 4 to be thick (0.4 mm thick) enough to prevent its non-bifurcate contact ends from being yieldingly bent or deformed when press-fitted in the through-holes in the printed circuit board.

What is claimed is:

1. An electric connector comprising:

an insulating housing having a plurality of slots formed therein, said slots being arranged in a pattern of columns and rows of said slots; and a plurality of separate and discrete, unitary signal terminals received in said slots of said insulating housing;

wherein said separate and discrete, unitary signal terminals are arranged in terminal pairs, each terminal pair having two of said separate and discrete, unitary signal terminals; and wherein each said terminal pair is received in one of said slots of said insulating housing.

2. An electric connector according to claim 1, wherein said slots in adjacent ones of said rows are staggered relative to one another such that adjacent ones of said columns of said slots overlap with each other.

3. An electric connector according to claim 1, wherein said signal terminals are arranged such that a ratio of "a"/"b" is less than or equal to ⅓, where "a" is a distance between the two signal terminals of each said terminal pair, and "b" is a distance between adjacent ones of said terminal pairs.

4. An electric connector according to claim 1, wherein each of said signal terminals has a contact end that is received in one of said slots of said insulating housing, a circuit board connection end, for connection to a circuit board, opposite said contact end, and a conductor extending from said contact end to said circuit board connection end; and said two signal terminals of each said terminal pair are substantially parallel to one another from said contact end to said circuit board connection end.

5. An electric connector according to claim 4, further comprising a terminal mounting block, said signal terminals being mounted in said terminal mounting block.

6. An electric connector according to claim 5, wherein said signal terminals are embedded in said terminal mounting block.

7. An electric connector according to claim 5, wherein said signal terminals are mounted in said terminal mounting block such that, for each signal terminal, said contact end and said circuit board connection end project in substantially mutually perpendicular directions.

8. An electric connector according to claim 5, further comprising:

an insulating member; and a plurality of counter terminals secured in said insulating member and arranged for each said counter terminal to be mated with said two signal terminals of one of said terminal pairs.

9. An electric connector according to claim 8, wherein each of said counter terminals comprises a pair of contact pieces separated from one another and joined together by an insulating material.

10. An electric connector according to claim 1, further comprising:

an insulating member; and a plurality of counter terminals secured in said insulating member and arranged for each said counter terminal to be mated with said two signal terminals of one of said terminal pairs.

11. An electric connector according to claim 10, wherein each of said counter terminals comprises a pair of contact pieces separated from one another and joined together by an insulating material.

12. An electric connector according to claim 1, wherein each of said slots of said insulating housing has a longitudinally-extending partition formed therein that extends only part way across said slot such that each said slot constitutes a single chamber, said two signal terminals of each said terminal pair being disposed on opposing sides of said partition in one of said slots.

13. An electric connector comprising:

an insulating housing having a plurality of slots formed therein, said slots being arranged in a pattern of columns and rows of said slots; and a plurality of signal terminals received in said slots of said insulating housing;

wherein said signal terminals are arranged in terminal pairs, each terminal pair having two of said signal terminals;

wherein each of said signal terminals has a bifurcate contact end; and wherein each said terminal pair is received in one of said slots of said insulating housing.

14. An electric connector according to claim 13, wherein said slots in adjacent ones of said rows are staggered relative to one another such that adjacent ones of said columns of said slots overlap with each other.

15. An electric connector according to claim 13, wherein said signal terminals are arranged such that a ratio of "a"/"b" is less than or equal to ⅓, where "a" is a distance between the two signal terminals of each said terminal pair, and "b" is a distance between adjacent ones of said terminal pairs.

16. An electric connector according to claim 13, wherein said bifurcate contact end of each said signal terminal is received in one of said slots of said insulating housing;

each of said signal terminals has a circuit board connection end, for connection to a circuit board, opposite said contact end, and a conductor extending from said contact end to said circuit board connection end; and said two signal terminals of each said terminal pair are substantially parallel to one another from said contact end to said circuit board connection end.

17. An electric connector according to claim 16, further comprising a terminal mounting block, said signal terminals being mounted in said terminal mounting block.

18. An electric connector according to claim 17, wherein said signal terminals are embedded in said terminal mounting block.

19. An electric connector according to claim 17, wherein said signal terminals are mounted in said terminal mounting block such that, for each signal terminal, said bifurcate contact end and said circuit board connection end project in substantially mutually perpendicular directions.

20. An electric connector according to claim 17, further comprising:

an insulating member; and a plurality of counter terminals secured in said insulating member and arranged for each said counter terminal to be mated with said two signal terminals of one of said terminal pairs.

21. An electric connector according to claim 20, wherein each of said counter terminals comprises a pair of contact pieces separated from one another and joined together by an insulating material.

22. An electric connector according to claim 13, further comprising:

an insulating member; and a plurality of counter terminals secured in said insulating member and arranged for each said counter terminal to be mated with said two signal terminals of one of said terminal pairs.

23. An electric connector according to claim 22, wherein each of said counter terminals comprises a pair of contact pieces separated from one another and joined together by an insulating material.

24. An electric connector according to claim 13, wherein each of said slots of said insulating housing has a longitudinally-extending partition formed therein that extends only part way across said slot such that each said slot constitutes a single chamber, said two signal terminals of each said terminal pair being disposed on opposing sides of said partition in one of said slots.

* * * * *